US007914731B2

(12) United States Patent
Laaber et al.

(10) Patent No.: US 7,914,731 B2
(45) Date of Patent: Mar. 29, 2011

(54) PROCESS FOR SINTERING ON A SINTERING MACHINE

(75) Inventors: Karl Laaber, Dietach (AT); Oskar Pammer, Linz (AT); Hans-Herbert Stiasny, Linz (AT); Anton Sebanz, Linz (AT); Karl Zehetbauer, Feldkirchen (AT)

(73) Assignee: Siemens Vai Metals Technology GmbH & Co. (AT)

( * ) Notice: Subject to any disclaimer, the term of this patent is extended or adjusted under 35 U.S.C. 154(b) by 261 days.

(21) Appl. No.: 12/161,205

(22) PCT Filed: Jan. 12, 2007

(86) PCT No.: PCT/EP2007/000264

§ 371 (c)(1),
(2), (4) Date: Oct. 2, 2008

(87) PCT Pub. No.: WO2007/082694

PCT Pub. Date: Jul. 26, 2007

(65) Prior Publication Data

US 2010/0242684 A1 Sep. 30, 2010

(30) Foreign Application Priority Data

Jan. 19, 2006 (AT) ..... A 91/2006

(51) Int. Cl.
*C22B 1/20* (2006.01)

(52) U.S. Cl. ..... 266/156; 266/178; 266/190; 266/196

(58) Field of Classification Search ..... 419/26; 75/757, 758, 765; 266/178, 156, 196, 190
See application file for complete search history.

(56) References Cited

U.S. PATENT DOCUMENTS 2,763,479 A * 9/1956 Huisken et al. ..... 266/78
3,003,863 A 10/1958 Meyer et al.
3,285,735 A 11/1966 Phelps et al.
3,909,189 A 9/1975 Ban (Continued)

FOREIGN PATENT DOCUMENTS

DE 42 34 085 A1 4/1994

(Continued)

OTHER PUBLICATIONS

Machine translation of JP 08-100222 published Apr. 16, 1996.*

(Continued)

*Primary Examiner* — George Wyszomierski
*Assistant Examiner* — Tima M McGuthry-Banks
(74) *Attorney, Agent, or Firm* — Ostrolenk Faber LLP

(57) ABSTRACT

A process for sintering metal-containing materials, such as iron ores or manganese ores, on a sintering machine including a sintering belt for transporting the sinter mix during sintering thereof. The sintering belt has first, second and third portions. Sintering waste gas from the third portion is transported to and unified with sintering waste gas from the first portion in a mixing region to form a mixed gas, wherein the transporting distance of the sintering waste gas from the third portion to the mixing region is greater than the transporting distance of the sintering waste gas from the first portion to the mixing region. An apparatus for carrying out the process is disclosed, including the sintering belt, suction boxes operative at the portions of the belt, and lines for conveying the gas produced and the gases used in the process.

16 Claims, 2 Drawing Sheets

U.S. PATENT DOCUMENTS

| | | | | |
|---|---|---|---|---|
| 4,023,960 | A | 5/1977 | Seidel et al. | |
| 2005/0172547 | A1 * | 8/2005 | Kikawa | 44/629 |

FOREIGN PATENT DOCUMENTS

| | | | |
|---|---|---|---|
| EP | 0 861 908 | A1 | 9/1998 |
| JP | 53 004706 | A | 1/1978 |
| JP | 58224124 | A * | 12/1983 |
| JP | 60 155626 | A | 8/1985 |
| JP | 02 200740 | A | 8/1990 |
| JP | 08 100222 | A | 4/1996 |
| SU | 1759921 | A1 | 9/1992 |
| WO | WO 03/102252 | | 12/2003 |

OTHER PUBLICATIONS

International Search Report dated May 2, 2007 issued in corresponding PCT application No. PCT/EP2007/000264.

* cited by examiner

PROCESS FOR SINTERING ON A SINTERING MACHINE

CROSS REFERENCE TO RELATED APPLICATION

The present application is a 35 U.S.C. §§371 national phase conversion of PCT/EP2007/000264, filed 12 Jan. 2007, which claims priority of Austrian Application No. A91/2006, filed 19 Jan. 2006. The PCT International Application was published in the German language.

BACKGROUND OF THE INVENTION

The invention relates to a process and an installation for sintering metal-containing materials, such as for example iron ores or manganese ores, in particular oxidic or carbonaceous ores, on a sintering machine with sintering waste gas return.

The sintering of metal-containing materials, such as for example iron ores or manganese ores, in particular oxidic or carbonaceous ores, takes place by means of sintering machines. After charging the sinter mix, which comprises the metal-containing material, revert material, solid fuel, fluxes, etc., onto the sintering belt of the sintering machine, the sinter mix is ignited on its surface in an ignition furnace. Subsequently, oxygen-containing gases are passed through the sinter mix as process gas, whereby the sintering front migrates from the surface of the sinter mix in the direction of the surface of the sintering belt. The gases used as process gas are, for example, fresh air, waste air from a sinter cooler, air used for pre-drying the sinter mix, a mixture of a number of these gases, or a mixture of one or more of these gases with tonnage oxygen. At the same time, the sintering belt is moved from the charging point in the direction of the discharging point. During the transport on the sintering belt, the entire sinter mix is sintered through and leaves the sintering belt at the discharge point as hot finished sinter. The hot finished sinter is cooled in a downstream sinter cooler. Sintering machines may be designed for example in the form of traveling grate sintering machines, in which the process gas is sucked through the sinter mix by negative pressure being applied to the suction boxes lying under the sintering belt by means of blowers.

During normal operation, the temperature and oxygen content of the sintering waste gas occurring change along the sintering belt. The temperature of the sintering waste gas increases along the sintering belt. The oxygen content of the sintering waste gas initially decreases along the sintering belt, to increase again after reaching a minimum. Usually, the temperature of the sintering waste gas in the front, first portion of the sintering belt is below 100° C. and increases toward the rear portion to over 300° C.

The process gas is sucked through the sinter mix by means of suction boxes positioned under the sintering belt and the sintering waste gas produced during this passage is collected and conducted away. Since the sintering operation requires large amounts of process gas, large amounts of sintering waste gas occur. The sintering waste gas contains, inter alia, evaporated water from the sinter mix, $CO_2$ and CO from the sometimes incomplete combustion of the fuel and calcination processes, also sulfur oxides $SO_x$, from the combustion of sulfur contained in the fuel or ore, as well as nitrogen oxides $NO_x$, dioxins, furans and dust. Before the sintering waste gas can be released into the environment as waste gas of the sintering machine, the removal of pollutants is therefore necessary to minimize the environmental impact. Reducing the amount of waste gas to be discharged from a sintering machine or the pollutant burden contained in the waste gas facilitates waste gas cleaning.

It is already known to reduce the amount of waste gas and the pollutant burden contained in the waste gas by returning part of the sintering waste gas to the sinter mix as process gas. One effect of this is that the amount of process gas that is introduced into the sintering machine from outside is reduced and another effect is that better use is made of the oxygen contained in it.

So, for example, JP-53-004706 describes partial return of the sintering waste gases to the sinter mix, the cold sintering waste gas from the front, first portion of the sintering belt being conducted to the hot sintering waste gas from the rear, third portion before both gases are unified. This means, however, that the transporting distance that the cold sintering waste gas has to cover before it is unified with the hot sintering gas is very long. This also means that the acid formed by the nitrogen oxides $NO_x$, sulfur oxides $SO_x$ and water vapor contained in the sintering waste gases will condense out in this long stretch over which they are conducted as a result of the temperature falling below the dew points of the acids. The acids condensing out are highly corrosive.

SUMARRY OF THE INVENTION

An object of the present invention is to minimize the transporting distance that has to be covered by the cool sintering waste gas from the first portion to unification with the hot sintering waste gas from the third portion, in order to mitigate corrosion problems.

This object is achieved by the hot sintering waste gas from the third portion, which does not cause any corrosion problems during normal operation, being brought up as close as possible to the first portion before it is unified with the sintering waste gas from the first portion.

The subject matter of the present invention is therefore a process for sintering metal-containing materials, such as for example iron ores or manganese ores, in particular oxidic or carbonaceous ores, on a sintering machine, in which process oxygen-containing process gas is passed through the sinter mix in three successive portions of the sintering belt, of which the first adjoins the charging zone on one side and the third ends at the discharge end of the sintering belt, and the sintering waste gas occurring in each of the portions is separately collected in suction boxes and conducted away, and the sintering waste gas from the first portion and the sintering waste gas from the third portion are fed as process gas to the second portion, and the sintering waste gas occurring in the second portion is discharged as waste gas from the sintering machine, and the hot finished sinter is cooled after discharge from the sintering belt, characterized in that the sintering waste gas from the third portion is transported to the sintering waste gas from the first portion and unified with the latter in a mixing region to form a mixed gas, wherein the transporting distance of the sintering waste gas from the third portion to the mixing region is greater than the transporting distance of the sintering waste gas from the first portion to the mixing region.

The length of the sintering belt is divided into three successive portions. Seen in the transporting direction of the sinter mix, the first portion begins after the charging zone, the third portion ends at the discharge end of the sintering belt. The second portion is bordered by the first and third portions.

The division of the portions is such that the amount of waste gas of the sintering machine is minimized and the process gas for the second portion has a certain temperature and a certain oxygen content during normal operation, possibly after adding waste air from a sinter cooler and/or fresh air and/or air used for pre-drying the sinter mix and/or tonnage oxygen to the mixed gas. The minimum temperature is 90° C., preferably 100° C., and the highest temperature is usually up to 150° C., preferably up to 130° C. The lower limit for the oxygen content is 15% by volume, preferably 17% by volume, but oxygen contents of up to 20% by volume or higher are also possible.

With this temperature of the process gas for the second portion, it is ensured that the risk of corrosion in the parts of the installation that are in contact with it is kept low. With this oxygen content, it is ensured that good sintering quality is achieved. It is preferred for the oxygen content of the process gas for the second portion to be as high as possible.

Depending on process parameters, such as for example sintering belt speed, composition of the sinter mix, oxygen content of the process gas, layer thickness of the sinter mix on the sintering belt, porosity of the sinter mix, negative pressure applied to the suction boxes, amount of process gas passed through, the proportion of each portion in terms of the overall length of the sintering belt varies within a certain range. The first portion of the sintering belt usually takes up 5-25% of the length of the sintering belt, preferably 10-20%. The second portion of the sintering belt, adjoining the first portion, usually takes up 50-85% of the length of the sintering belt, preferably 55-75%. The third portion of the sintering belt, adjoining the second portion of the sintering belt, usually takes up 10-25% of the length of the sintering belt, preferably 15-20%.

Each portion of the sintering belt is assigned the suction boxes arranged under it. The portions of the sintering belt are respectively assigned at least two suction boxes. The sintering waste gas from each portion of the sintering belt is collected in the suction boxes assigned to the respective portion separately from the sintering waste gas of the other portions and is conducted away from these assigned suction boxes, it preferably being possible for the conducting away of the sintering waste gas to be controlled.

The sintering waste gas from the third portion is transported to the sintering waste gas from the first portion and unified with the latter in a mixing region to form a mixed gas. In this respect, the transporting distance of the sintering waste gas from the third portion to the mixing region is greater than the transporting distance of the sintering waste gas from the first portion to the mixing region. Since the path that the cold sintering waste gas from the first portion has to cover before it reaches the mixing region is intended to be as short as possible, the sintering waste gas from the third portion is to be unified with the sintering waste gas from the first portion close to the first portion. It is therefore particularly preferred that the sintering waste gas from the first portion is unified with the sintering waste gas from the third portion directly under the first portion. Depending on how the sintering machine is constructed, however, it may also be necessary to arrange the mixing region somewhat further away from the first portion.

The mixed gas obtained by unifying the sintering waste gases from the first and third portions is fed to the second portion as process gas for the second portion.

In order to obtain the values for temperature and oxygen content of the process gas for the second portion that are optimal for good sintering quality, the lengths of the portions may be varied within the ranges specified, and consequently the properties of the mixed gas or the process gas for the second portion may be varied. Depending on the embodiment of the process, the entire sintering waste gas from the third portion is unified with the entire sintering waste gas from the first portion. According to another embodiment, part of the sintering waste gas of one portion is fed to the sintering waste gas of a neighboring portion. Preferably, only the sintering waste gas occurring in the bordering regions of the portions is fed to the sintering waste gas of a neighboring portion. The bordering region is understood here as meaning a region that extends on both sides of the border between the portions into the two neighboring portions respectively over a length of up to 30% of the length of the portion concerned. Furthermore, to set the temperature and the oxygen content of the process gas for the second portion, waste air from a sinter cooler and/or fresh air and/or air used for pre-drying the sinter mix and/or tonnage oxygen may be added to the mixed gas. These measures allow the amount, temperature and oxygen content of the sintering waste gases of the individual portions, and consequently of the mixed gas or the process gas for the second portion, to be varied in the desired way.

The oxygen-containing process gas for the first and/or third portions may be, for example, fresh air, waste air from a sinter cooler, air used for pre-drying the sinter mix, a mixture of a number of these gases or a mixture of one or more of these gases with tonnage oxygen. Preferred are the use of fresh air, the use of waste air from a sinter cooler, the use of a mixture of fresh air and waste air from a sinter cooler, the use of a mixture of tonnage oxygen and fresh air, the use of a mixture of tonnage oxygen and waste air from a sinter cooler and the use of a mixture of tonnage oxygen, fresh air and waste air from a sinter cooler.

The amount, temperature and oxygen content of the sintering waste gases of the individual portions, and consequently of the mixed gas or the process gas for the second portion, can be varied in the desired way by the choice of oxygen-containing process gas.

According to a preferred embodiment of the process according to the invention, the sintering waste gas from the second portion is heated with the aid of the sintering waste gas from the third portion, without the two sintering waste gases mixing. By raising the temperature, the risk of corrosion in the lines carrying the sintering waste gas from the second portion, caused by acids condensing out as a result of the temperature falling below their dew point, is reduced. This takes place by the sintering waste gases from the three portions being conducted within a general line. The general line is divided in its inner region by longitudinally running separating walls into individual gas ducts in such a way that the hot sintering waste gas from the third portion cannot mix with the cooler sintering waste gas from the second portion, but part of its heat can be transferred to the sintering waste gas from the second portion. Furthermore, the dusts occurring from the sintering waste gases of the various portions may be discharged separately in a gastight manner, for example by means of chutes with gastight dust collectors, from the gas ducts carrying the sintering waste gases.

The unified sintering waste gases from the second portion are discharged as waste gas from the sintering machine. In the unification of the sintering waste gases from the individual suction boxes, in each case a colder sintering waste gas is introduced into a warmer sintering waste gas or into the unified warmer sintering waste gases.

Preferably, the mixed gas is dedusted before it is used as process gas for the second portion.

Preferably, the sintering waste gas from the second portion is cleaned during its discharge as waste gas from the sintering machine, in that for example it is dedusted and nitrogen oxides $NO_x$ or sulfur oxides $SO_x$ and other pollutants are removed.

The dusts obtained in these dedusting and cleaning operations and the dusts obtained in the discharge from the gas ducts are used as additional material for the production of the sinter mix to the extent to which this is possible in terms of the process technology.

Further subject matter of the invention is an apparatus for sintering metal-containing materials, such as for example iron ores or manganese ores, in particular oxidic or carbonaceous ores, on a sintering machine with a charging device for a sinter mix containing solid fuel on a sintering belt, with an igniting device for igniting the sinter mix on the surface, with suction boxes for passing oxygen-containing process gas through the sinter mix in three successive portions of the sintering belt, of which the first portion adjoins the charging device and the third portion is bordered by the discharge end of the sintering belt, with a collecting line for unifying and passing on the sintering waste gas occurring in the suction boxes of the third portion, with a discharge line for unifying and passing on the sintering waste gas occurring in the suction boxes of the second portion, with a device for producing a mixed gas from the sintering waste gas from the first portion of the sintering belt and the sintering waste gas from the third portion of the sintering belt, with connecting lines for feeding the sintering waste gases from the suction boxes of the third portion into the collecting line, with connecting lines for feeding the sintering waste gases from the suction boxes of the second portion into the discharge line, and with connecting lines for feeding the sintering waste gases from the suction boxes of the first portion into the device for producing a mixed gas, with a device for transporting and distributing the mixed gas as process gas for the second portion to the sinter mix in the second portion of the sintering belt, with a waste gas line for discharging the gas from the discharge line for sintering waste gas from the second portion of the sintering belt from the sintering machine, and with a sinter cooler, arranged downstream of the discharge end of the sintering belt, characterized in that the device for producing a mixed gas comprises the collecting line for the sintering waste gases from the third portion of the sintering belt, into which line the connecting lines for feeding in the sintering waste gas from the suction boxes of the first portion of the sintering belt open out in a mixing region and in which the distance of the third portion from the mixing region is greater than the distance of the first portion from the mixing region.

The process gas is passed through the sinter mix, in that a negative pressure is applied to the suction boxes lying under the sintering belt by means of blowers. As a result, the process gas is sucked through the sinter mix into the suction boxes. Advantageously, altogether at least two, preferably speed-regulated, blowers are provided for sucking the process gases through the first and third portions and through the second portion.

The first portion of the sintering belt usually takes up 5-25% of the length of the sintering belt, preferably 10-20%. The second portion of the sintering belt, adjoining the first portion, usually takes up 50-85% of the length of the sintering belt, preferably 55-65%. The third portion of the sintering belt, adjoining the second portion of the sintering belt, usually takes up 10-25% of the length of the sintering belt, preferably 15-20%. With appropriate division, during normal operation the sintering waste gases, the mixed gas and the process gas for the second portion have the desired temperatures and oxygen contents for performing the process according to the invention.

In the collecting line, the sintering waste gases occurring in the suction boxes of the third portion are unified and conducted away from the third portion. The sintering waste gas from the respective suction boxes is transported into the collecting line through connecting lines.

In the discharge line, the sintering waste gases occurring in the suction boxes of the second portion are unified and conducted away from the second portion. The sintering waste gas from the respective suction boxes is transported into the discharge line through connecting lines. In the unification of the sintering waste gases from the individual suction boxes, in each case a colder sintering waste gas is introduced into the unified, warmer sintering waste gases.

The device for producing a mixed gas from the sintering waste gas from the first portion and the sintering waste gas from the third portion comprises a collecting line, into which the connecting lines extending from the suction boxes of the first portion open out. The region of the collecting line in which the connecting lines extending from the suction boxes of the first portion open out is the mixing region. Through these connecting lines, the sintering waste gas from the first portion is fed into the collecting line. According to the invention, the distance of the third portion from the mixing region is greater than the distance of the first portion from the mixing region.

Preferably, the mixing region lies under the first portion. The device for producing a mixed gas is arranged under or to the side of the sintering belt. It preferably runs parallel to the sintering belt. A parallel run allows a compact type of construction of the apparatus according to the invention.

In the waste gas line, the gas from the discharge line is discharged from the sintering machine.

According to a preferred embodiment of the apparatus according to the invention, at least two suction boxes are arranged under each portion.

According to a preferred embodiment, a throttle device, for example a throttle valve, is provided in at least one of the connecting lines extending from the suction boxes of the three portions. By means of this throttle device, the transporting of the sintering waste gas from the suction box connected to the connecting line can be regulated.

According to a preferred embodiment, the device for producing a mixed gas and the discharge line for the sintering waste gas from the second portion of the sintering belt are arranged as neighboring gas ducts that are separated from each other by separating walls in the interior of a general line arranged under the suction boxes and preferably running parallel to the sintering belt. The arrangement under the suction boxes parallel to the sintering belt allows a particularly compact type of construction of the apparatus. Within the general line, heat exchange takes place between the neighboring gas ducts. The temperature of the sintering waste gas from the second portion of the sintering belt is thereby increased by the warmer sintering waste gas from the third portion of the sintering belt. This temperature increase reduces the risk of corrosion in the discharge line. Preferably, chutes with gastight dust collectors are provided in the gas ducts of the general line for discharging the dusts that are precipitated. To the extent possible in terms of the process technology, these dusts can be used in the production of the sinter mix.

According to a preferred embodiment, the device for transporting and distributing the mixed gas as process gas for the second portion to the sinter mix in the second portion of the sintering belt comprises a return line, containing at least a dedusting installation, and a distribution hood. The return line opens out at one end into the mixing region of the device for producing a mixed gas and at the other end into the distribution hood. The dedusting installation is, for example, a cyclone or an electrostatic precipitator.

According to a preferred embodiment, a dedusting installation and/or a waste gas cleaning installation, with for example a dedusting installation and an installation for removing $NO_x$ and $SO_x$, is provided in the waste gas line.

The dedusting installations in the return line, in the waste gas line and in the waste gas cleaning installation separate out entrained dust from the mixed gas or the waste gas. To the extent possible in terms of the process technology, the separated dust can be used in the production of the sinter mix.

According to a preferred embodiment, lines for feeding in waste air from the sinter cooler and/or fresh air and/or air used for pre-drying the sinter mix and/or tonnage oxygen open out into the return line. The gases fed through these lines allow the temperature and the oxygen content of the mixed gas to be changed before it is conducted via the distribution hood as process gas for the second portion to the sinter mix in the second portion of the sintering belt.

According to a preferred embodiment, a static mixer is provided in the return line, located before the end of the return line that opens out into the distribution hood.

According to a further preferred embodiment of the apparatus according to the invention, the connecting lines extending from the suction boxes each have two openings, one of which leads into the collecting line of the device for producing a mixed gas and the other of which leads into the discharge line.

Preferably, only those connecting lines that extend from the suction boxes that lie in the bordering region of neighboring portions have two openings each. The openings can be opened and closed, with preferably one opening respectively being closed and one opening respectively being open.

In this way, it can be controlled whether part of the sintering waste gas of a portion is passed on together with the residual sintering waste gas of the corresponding portion, or whether it is passed on together with the sintering waste gas of the neighboring portion.

According to a further preferred embodiment, lines for feeding in waste air from the sinter cooler to the first and/or third portion of the sintering belt are provided. This allows waste air from the sinter cooler to be used as process gas, or as a constituent of the process gas, in each of the two portions. A dedusting installation is preferably provided in the lines for feeding in waste gas from the sinter cooler. To the extent possible in terms of the process technology, the dust separated in this dedusting installation can be used in the production of the sinter mix.

According to a preferred embodiment, lines for mixing in tonnage oxygen open out into the lines for feeding in waste air from the sinter cooler to the first and/or third portion of the sintering belt.

According to a further preferred embodiment, lines for mixing tonnage oxygen into the process gases for the first and/or third portions of the sintering belt are provided.

DESCRIPTION OF A PREFERRED EMBODIMENT

Figure 1:
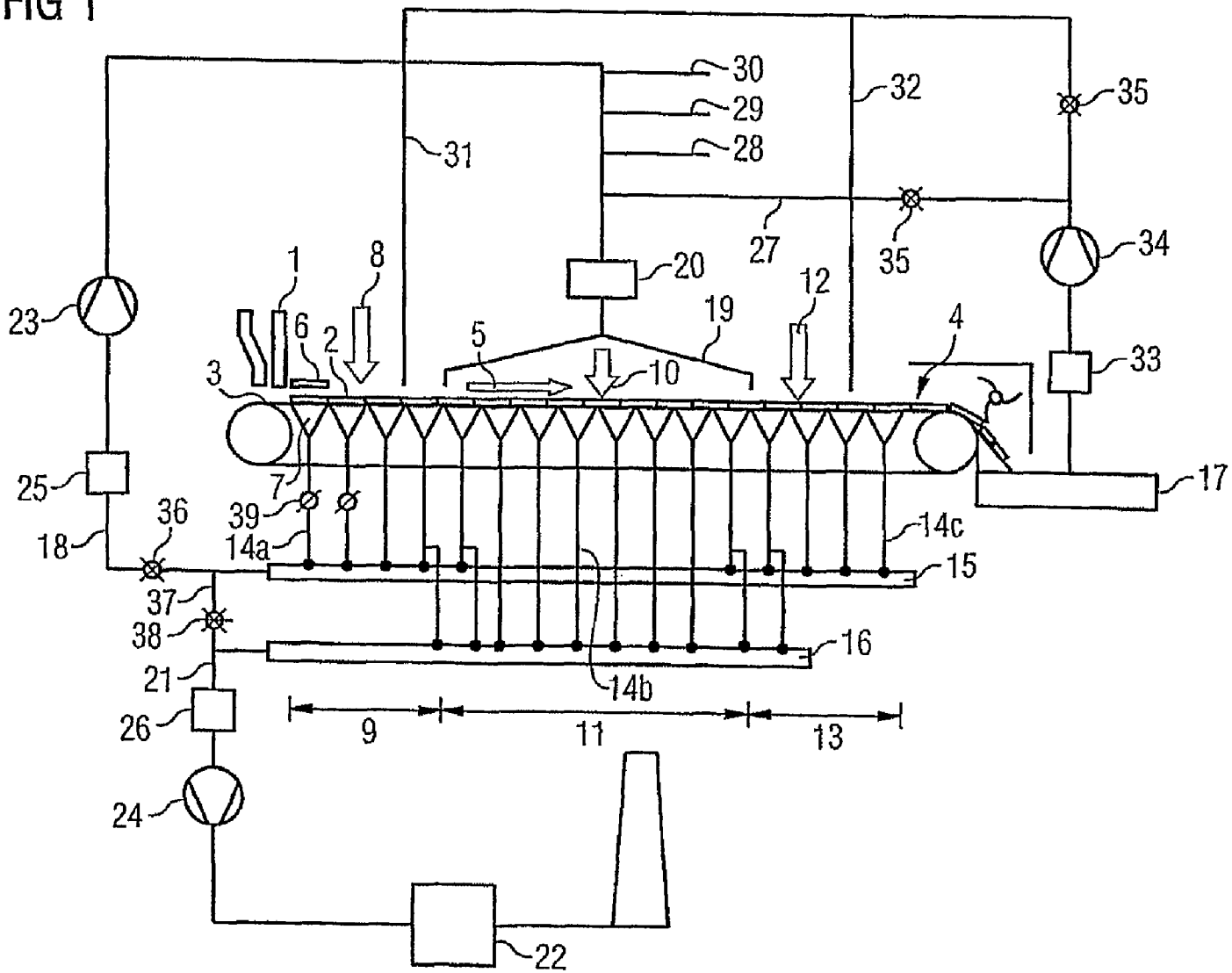
FIG. 1 shows a schematic flow diagram of a sintering machine operating according to the invention.

FIG. 1 shows a schematic flow diagram of a sintering machine operating according to the invention. By means of the charging device 1, the sinter mix 2, containing solid fuel, is charged onto the sintering belt 3. The sintering belt 3, laden with sinter mix 2, runs from the charging device 1 in the direction of the discharge end 4 of the sintering belt and transports the sinter mix 2 away from the charging device 1.

The running direction is identified by an arrow 5. In the igniting device 6, the sinter mix 2 is ignited on the surface. By means of suction boxes 7 arranged under the sintering belt 3, process gas 8 is passed through the sinter mix 2 in the first portion 9 of the sintering belt, process gas 10 is passed through the sinter mix 2 in the second portion 11 of the sintering belt, and process gas 12 is passed through the sinter mix 2 in the third portion 13 of the sintering belt. Connecting lines 14*a*, 14*b*, 14*c* conduct the sintering waste gas away from the suction boxes 7. The sintering waste gas occurring in the suction boxes 7 under the first portion 9 is fed via the connecting lines 14*a* in the mixing region into the collecting line 15 of the device for producing a mixed gas. The sintering waste gas occurring in the suction boxes under the second portion 11 is fed via the connecting lines 14*b* into the discharge line 16. The sintering waste gas occurring in the suction boxes under the third portion 13 is fed via the connecting lines 14*c* into the collecting line 15. Arranged downstream of the discharge end 4 of the sintering belt is a sinter cooler 17. The mixed gas from the device for producing a mixed gas is conducted via a return line 18 and a distribution hood 19 as process gas 10 to the sinter mix 2 in the second portion 11. Upstream of the distribution hood 19 there is a static mixer 20 in the return line 18. The sintering waste gas from the second portion 11 is fed via a waste gas line 21 to a waste gas cleaning installation 22 before it is released into the environment. A blower 23 provides for the mixed gas to be transported in the return line 18. A blower 24 provides for the sintering waste gas from the second portion 11 to be transported in the discharge line 16 and in the waste gas line 21. In the return line 18 there is a dedusting installation 25. In the waste gas line 21 there is a dedusting installation 26. A line 27 for feeding in waste air from the sinter cooler, a line 28 for feeding in fresh air, a line 29 for feeding in air used for pre-drying the sinter mix and a line 30 for feeding in tonnage oxygen open out into the return line 18. The connecting lines 14*a*, the connecting lines 14*b* and the connecting lines 14*c*, which extend from suction boxes 7 in the bordering region of the first portion 9 and second portion 11 and from suction boxes 7 in the bordering region of the second portion 11 and third portion 13, respectively, open out both into the collecting line 15 of the device for producing a mixed gas and into the discharge line 16. The lines 31 and 32 feed waste gas from the sinter cooler 17 to the first portion 9 and the third portion 13. The waste air from the sinter cooler is thereby dedusted by means of a dedusting installation 33 and transported by means of a blower 34.

Butterfly valves 35 regulate the gas flow in the lines 27, 31 and 32 for feeding in waste air from the sinter cooler. The gas flow in the return line 18 is regulated by means of a butterfly valve 36. A line connection 37 connects the return line 18 to the waste gas line 21. The mixed gas can be fed into the waste gas line 21 of the sintering machine via this line connection 37, for example during the starting up of the installation. The gas flow in the line connection 37 is regulated by means of a shut-off valve 38. Butterfly valves 39 in two connecting lines 14*a* make it possible to regulate the gas flow through these two connecting lines 14*a*.

Figure 2:
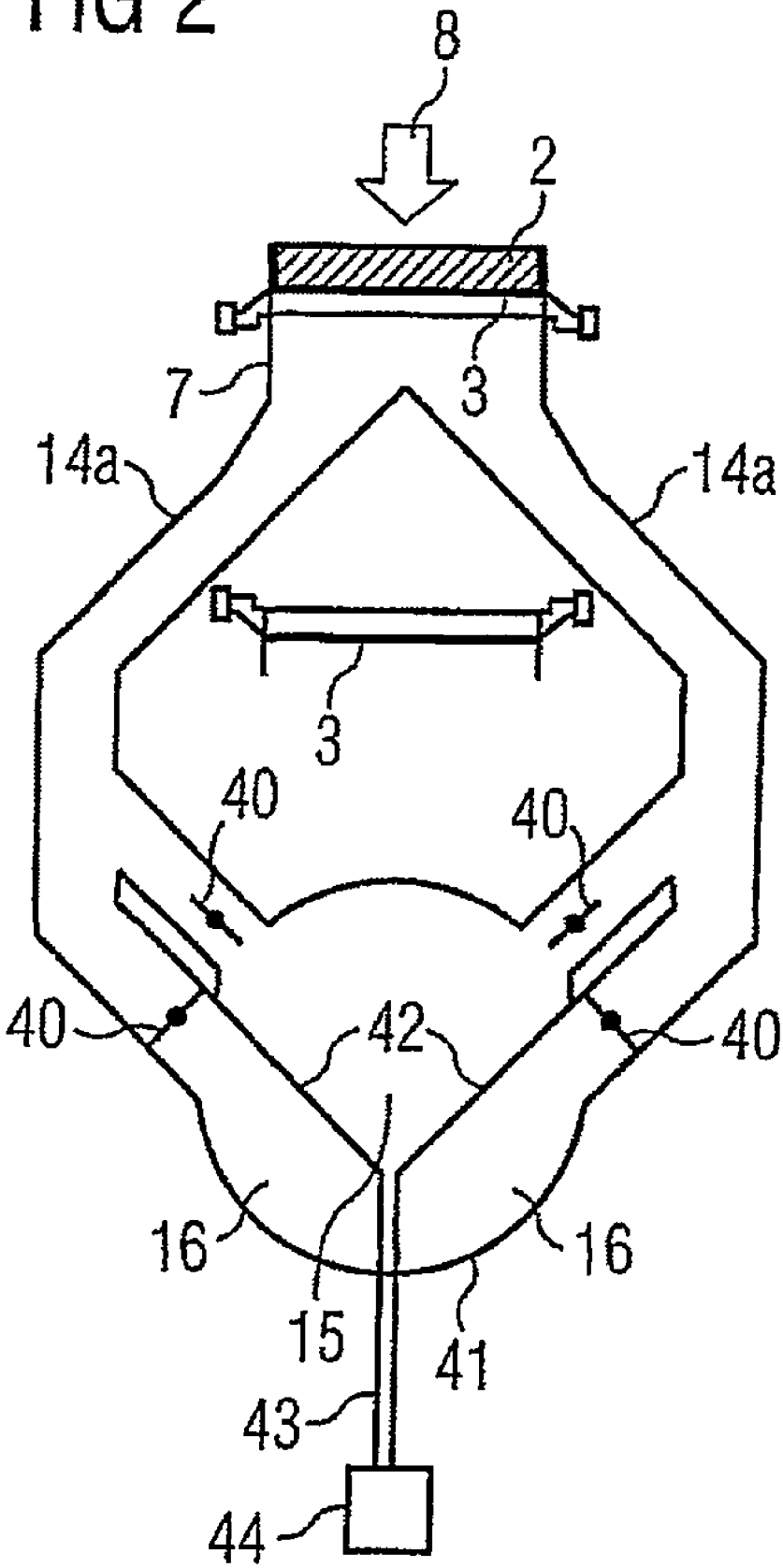
FIG. 2 shows a schematic section in the bordering region of two portions through a sintering machine with a general line.

FIG. 2 shows a schematic section in the bordering region of the first and second portions through a sintering machine with a general line. Oxygen-containing process gas 8 is conducted by means of suction boxes 7 through the sinter mix 2 located on the sintering belt 3. The sintering waste gas occurring is introduced into the collecting line 15 of the device for producing a mixed gas through the connecting line 14*a*. The connecting line 14*a* has an opening that opens out into the collecting line 15 and an opening that opens out into the discharge line 16. Shut-off valves 40 are located before the openings. If the opening into the collecting line 15 is open, the opening into the discharge line 16 is closed by the shut-off valve 40. The collecting line 15 and the discharge line 16 are arranged within a general line 41 as neighboring gas ducts that are separated from each other by separating walls 42. For the discharge of the dust occurring in the collecting line 15, a chute 43 with a gastight dust collector 44 is provided in the collecting line 15.

The invention claimed is:

1. An apparatus for sintering metal-containing materials, comprising a sintering machine including a charging device for charging a sinter mix containing solid fuel, a movable sintering belt having a surface with an entrance area to which the charging device charges the sinter mix and having a discharge area where a sinter leaves the belt;

an igniting device operable for igniting the sinter mix on the surface;

suction boxes positioned and operable for passing oxygen-containing process gas through the sinter mix on the belt at three successive portions along the sintering belt, wherein a first portion of the belt adjoins the charging device and a third portion of the belt is bordered by the discharge area of the sintering belt;

a first collecting line connected to and operable for unifying and passing on sintering waste gas occurring in the suction boxes of the third portion, and second connecting lines connected between and operable for feeding the sintering waste gases from the suction boxes of the third portion into the first collecting line;

a discharge line connected to and operable for unifying and passing on sintering waste gas occurring in the suction boxes of the second portion, and third connecting lines connected to and operable for feeding the sintering waste gases from the suction boxes of a second portion of the belt into the discharge line;

a device for producing a mixed gas from sintering waste gas from the first portion of the sintering belt and the sintering waste gas from the third portion of the sintering belt, and fourth connecting lines for feeding the sintering waste gases from the suction boxes of the first portion into the device for producing a mixed gas;

the device for producing a mixed gas comprises the first collecting line for the sintering waste gases from the third portion of the sintering belt;

a device operable for transporting and distributing the mixed gas as process gas to be used for the second portion to the sinter mix in the second portion of the sintering belt;

a waste gas line connected to and operable for discharging from the discharge line the sintering waste gas from the second portion of the sintering belt and for discharging that gas from a sintering machine;

a sinter cooler arranged downstream of the discharge area of the sintering belt;

a mixing region of the first collecting line;

the fourth connecting lines for feeding in the sintering waste gas from the suction boxes of the first portion of the sintering belt open out into the mixing region, wherein the distance of the third portion from the mixing region is greater than the distance of the first portion from the mixing region; and the connecting lines extending from at least some of the suction boxes each have two openings, wherein one of the openings leads into the collecting line of the device for producing a mixed gas and the other of the openings leads into the discharge line.

2. The apparatus as claimed in claim 1, wherein the mixing region lies under the first portion.

3. The apparatus as claimed in claim 1, wherein the first collecting line of the device for producing a mixed gas runs parallel to the sintering belt between the entrance and discharge areas of the belt.

4. The apparatus as claimed in claim 1, further comprising at least two of the suction boxes arranged under each portion of the sintering belt in a direction along the belt.

5. The apparatus as claimed in claim 1, wherein the device for producing a mixed gas and the discharge line for the sintering waste gas from the second portion of the sintering belt comprise and are arranged as neighboring gas ducts that are separated from each other inside a general line arranged under the suction boxes.

6. The apparatus as claimed in claim 5, further comprising chutes with gastight dust collectors connected for discharging dust occurring in the gas ducts.

7. The apparatus as claimed in claim 1, wherein the first portion of the sintering belt takes up 15-25% of the length of the sintering belt, the second portion takes up 50-65% of the length of the sintering belt, and the third portion takes up 10-25% of the length of the sintering belt.

8. The apparatus as claimed in claim 1, wherein the device for transporting and distributing the mixed gas to the sinter mix in the second portion of the sintering belt comprises a return line, containing at least a dedusting installation, and a distribution hood.

9. The apparatus as claimed in claim 8, further comprising lines for feeding in at least one of waste air from the sinter cooler, fresh air, air used for pre-drying the sinter mix and tonnage oxygen open into the return line.

10. The apparatus as claimed in claim 8, further comprising a static mixer in the return line.

11. The apparatus as claimed in claim 1, further comprising at least one of a dedusting installation and a waste gas cleaning installation in the waste gas line.

12. The apparatus as claimed in claim 1, wherein there are bordering region suction boxes that lie in bordering regions of neighboring portions of the belt and only those cormecting lines that extend from the suction boxes in the bordering regions have two openings each.

13. The apparatus as claimed in claim 1, further comprising lines for feeding in waste air from the sinter cooler to at least one of the first portion and the third portion of the sintering belt.

14. The apparatus as claimed in claim 1, further comprising at least two blowers for sucking the process gases through the first portion and the third portion and the second portion and through the sinter mix on the belt.

15. The apparatus as claimed in claim 1, further comprising a throttle device in at least one of the connecting lines.

16. The apparatus as claimed in claim 5, wherein the general line runs parallel to the sintering belt.

* * * * *